US006973958B1

(12) United States Patent
Chou

(10) Patent No.: US 6,973,958 B1
(45) Date of Patent: Dec. 13, 2005

(54) HEAT TRANSFER APPARATUS HAVING ANTI-OXIDIZATION DEVICE

(76) Inventor: Ching-Lung Chou, No. 15, Yichang East Road, Taiping City, Taichung Hsien 411 (TW)

( * ) Notice: Subject to any disclaimer, the term of this patent is extended or adjusted under 35 U.S.C. 154(b) by 12 days.

(21) Appl. No.: 10/968,558

(22) Filed: Oct. 19, 2004

(51) Int. Cl.[7] ..... F25B 29/00

(52) U.S. Cl. ..... 165/11.1; 165/61; 165/63; 165/64; 165/119; 165/134.1; 165/263; 165/264; 165/279; 165/286; 62/201; 62/434; 62/435

(58) Field of Search ..... 165/11.1, 61, 63, 165/64, 119, 263, 264, 279, 286, 134.1; 62/201, 62/434, 435; 210/96.1

(56) References Cited

U.S. PATENT DOCUMENTS 2,673,940 A * 3/1954 Slifkin ..... 165/104.31
3,454,491 A * 7/1969 Colburn ..... 210/85
4,294,799 A * 10/1981 Stephens et al. ..... 165/287
4,787,444 A * 11/1988 Countryman ..... 165/48.2
5,575,159 A * 11/1996 Dittell ..... 62/201
5,970,729 A * 10/1999 Yamamoto et al. ..... 62/178
6,350,376 B1 * 2/2002 Imaoka et al. ..... 210/96.1
6,405,551 B1 * 6/2002 Kuwabara et al. ..... 62/434
6,446,449 B2 * 9/2002 Krauter ..... 62/201
2003/0007136 A1 * 1/2003 Emoto et al. ..... 355/30
2003/0209609 A1 * 11/2003 Takamura et al. ..... 165/287

FOREIGN PATENT DOCUMENTS

JP 10272492 A * 10/1998 ..... C02F 9/00

* cited by examiner

*Primary Examiner*—John K. Ford
(74) *Attorney, Agent, or Firm*—Charles E. Baxley

(57) ABSTRACT

A heat transfer apparatus includes one heat exchanging system having a compressor coupled between a condenser and a heat exchanger. A further heat exchanging system includes a water pump, an ion exchange filter coupled between the water pump and the heat exchanger, to filter negative ions, positive ions, mineral materials, and/or impurities from the water. A temperature detecting member may actuate a heater to maintain the water temperature. A water cycling system includes a water reservoir to maintain the water pressure in the further heat exchanging system. An air relief valve may relieve air bubbles to reduce shocks and vibrations in the heat exchanging system.

6 Claims, 1 Drawing Sheet

HEAT TRANSFER APPARATUS HAVING ANTI-OXIDIZATION DEVICE

BACKGROUND OF THE INVENTION

1. Field of the Invention

The present invention relates to a heat transfer apparatus, and more particularly to a heat transfer apparatus having an anti-oxidization device for preventing water tubings from oxidization, and for reducing air bubbles from being generated within and flown through the water tubings.

2. Description of the Prior Art

Various kinds of typical heat transfer apparatuses have been developed and comprise a number of tubing systems or piping systems coupled between heat transfer members or devices, and water or other refrigerants flowing through the tubing systems or piping systems, for heat transferring or exchanging purposes.

For example, U.S. Pat. No. 4,787,444 to Countryman, and U.S. Pat. No. 5,575,159 to Dittell disclose two of the typical heat transfer apparatuses each also comprising water or other heat transfer fluid pumped or drawn by such as compressors, through heat exchangers, heaters, evaporators, condensers, etc., for heat transferring or exchanging between the heat transfer members or devices.

However, normally, the heat transfer fluid, such as the water may contain negative ions, positive ions, mineral materials, impurities, etc. which may increase electric resistance of the water, and which may increase electric conductivity of the water, and which may cause the tubing or piping systems to be easily rusted by the water.

For preventing the tubing or piping systems from being rusted, the tubing or piping systems are required to be made of stainless steel which is expensive, and anti-rusting agent is required to be filled into the tubing or piping systems. However, the anti-rusting agent normally will pollute our environment.

In addition, in operation, air bubbles may be generated within and flown through the water tubing or piping systems, and may thus generate great shocks and vibrations within the water tubing or piping systems, such that the coupling between the water tubing or piping systems and the heat transfer members or devices.

The present invention has arisen to mitigate and/or obviate the afore-described disadvantages of the conventional heat transfer apparatuses.

SUMMARY OF THE INVENTION

The primary objective of the present invention is to provide a heat transfer apparatus including an anti-oxidization device for preventing water tubings from being oxidized by the water flowing through the water tubings.

The other objective of the present invention is to provide a heat transfer apparatus including an anti-oxidization device for reducing air bubbles from being generated within and flown through the water tubings, and thus for reducing or avoiding shocks and vibrations that will normally be generated within the water tubings.

In accordance with one aspect of the invention, there is provided a heat transfer apparatus comprising a first heat exchanging system including a condenser and a heat exchanger coupled together, a compressor coupled between the condenser and the heat exchanger for pumping a heat exchanging fluid through the condenser and the heat exchanger, a filter, an expansion valve, and a solenoid valve coupled between the condenser and the heat exchanger, for filtering the heat exchanging fluid and for controlling a flowing of the heat exchanging fluid through the first heat exchanging system, a second heat exchanging system including a water inlet for receiving water, a water pump coupled to the water inlet to force the water from the water inlet into the heat exchanger, a water filter and an ion exchange filter coupled between the water pump and the heat exchanger, to filter negative ions, positive ions, mineral materials, and/or impurities from the water, and for decreasing an electric conductivity of the water, a switch coupled between the ion exchange filter and the heat exchanger, to control the water flowing into the heat exchanger, a water tank coupled to the heat exchanger, and coupled to an outlet, for supplying the water of lower water temperature and lower water pressure out of the second heat exchanging system, the water tank including an entrance and an exit, a water detector coupled to the water tank, to detect water quality in the water tank, an electric conductometer coupled to the water detector, to display an electric conductivity of the water in the water tank, a heater coupled to the water tank, to selectively heat the water in the water tank, a temperature detecting member coupled to the water tank, to detect a water temperature in the water tank, to control and to actuate the heater to heat the water in the water tank when the temperature detecting member has detected that the water temperature in the water tank is lower than a predetermined temperature, and to maintain the water temperature in the second heat exchanging system. A water cycling system may further be provided and includes a water reservoir coupled to the entrance of the water tank, to receive the water from the water tank, the water reservoir including a discharge port coupled to the water pump via a control valve, to supply the from the water reservoir to the water pump of the second heat exchanging system, a pressure detecting member may be coupled to the water reservoir, to detect a pressure in the water reservoir, and to actuate the control valve to supply the water from the water reservoir to the water pump of the second heat exchanging system, and to maintain the water pressure in the second heat exchanging system, and an air relief valve is coupled between the water pump and the water filter, to relieve air bubbles generated within the water, and to reduce shocks and vibrations that may be generated within the second heat exchanging system.

The first heat exchanging system includes a pressure gauge attached and coupled between the condenser and the heat exchanger, to detect a fluid pressure within the first heat exchanging system.

The first heat exchanging system includes a bypass manifold coupled between the condenser and the heat exchanger, and a switch coupled to the bypass manifold, to control the heat exchanging fluid to directly flow from the condenser to the compressor when the fluid pressure within the first heat exchanging system is detected to be lower than a predetermined pressure.

The second heat exchanging system includes a check valve coupled between the water filter and the water reservoir, to prevent the water from flowing backward into the water reservoir from the water filter. The second heat exchanging system includes a pressure gauge coupled to the water tank, to detect the water pressure in the water tank.

The second heat exchanging system includes a temperature controller coupled to the temperature detecting member, to control and to actuate the heater when the temperature detecting member has detected that the water temperature in the water tank is lower than a predetermined temperature.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
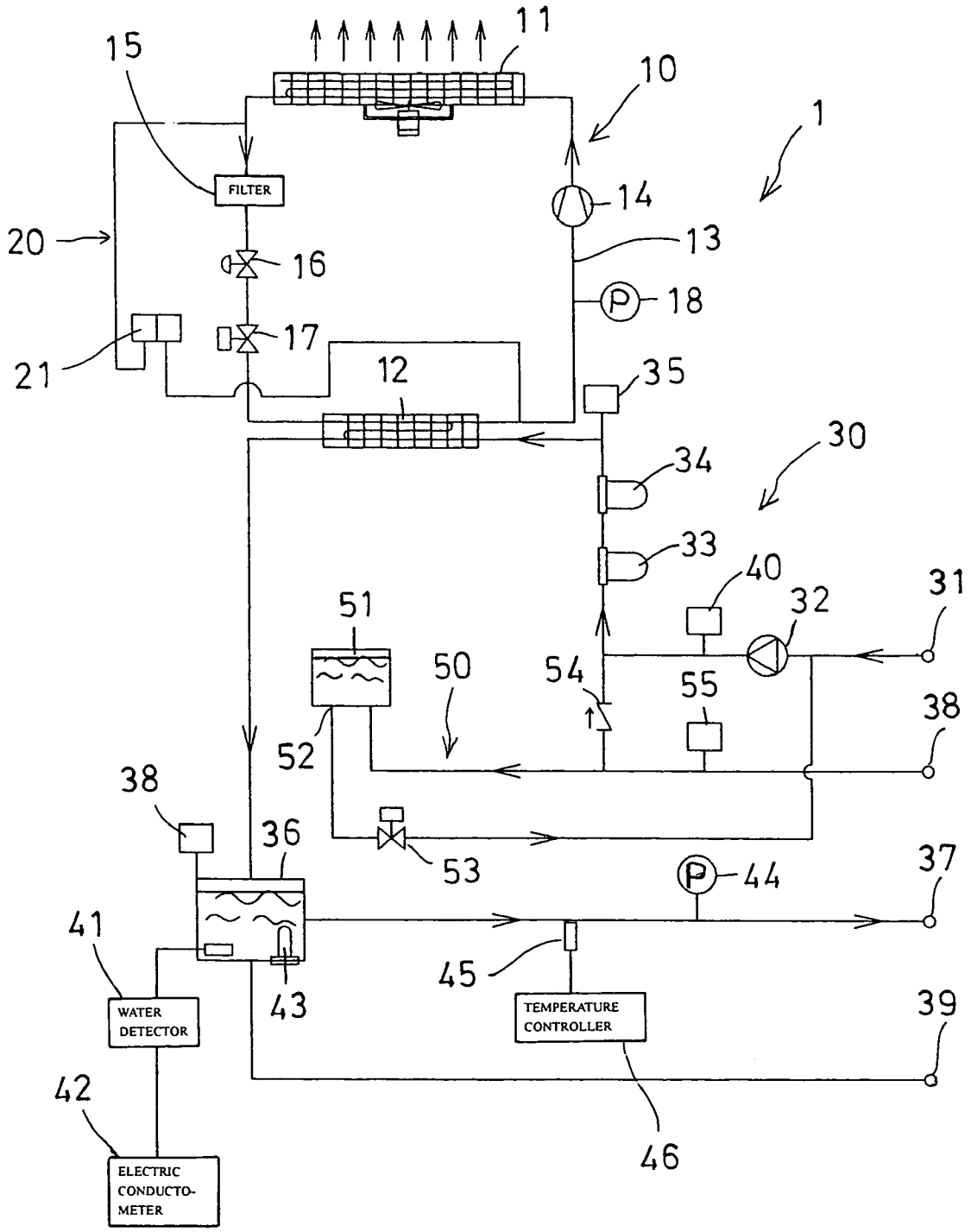
FIG. 1 is a block diagram illustrating a heat transfer apparatus in accordance with the present invention.

Referring to the drawing figure, a heat transfer apparatus 1 in accordance with the present invention comprises a first heat exchanging system 10 including a condenser 11 and a heat exchanger 12 coupled together with tubing members 13, a compressor 14 coupled between the condenser 11 and the heat exchanger 12, for pumping high temperature and high pressure coolant or heat exchanging fluid into the condenser 11 and through the tubing members 13 and the heat exchanger 12.

A filter 15, an expansion valve 16, and a solenoid valve 17 are coupled between the condenser 11 and the heat exchanger 12, for filtering the heat exchanging fluid flown through the tubing members 13, or for controlling the flowing of the heat exchanging fluid through the tubing members 13. A pressure gauge 18 may be attached to the tubing members 13, or coupled between the condenser 11 and the heat exchanger 12, for detecting or showing fluid pressure within the tubing members 13 of the first heat exchanging system 10.

The first heat exchanging system 10 may further includes a bypass manifold 20 coupled between the outlets of the condenser 11 and the heat exchanger 12, and a switch 21 attached or coupled to the bypass manifold 20, to control the heat exchanging fluid to directly flow from the outlet of the condenser 11 to the compressor 14, when the fluid pressure within the tubing members 13 of the first heat exchanging system 10 is detected to be lower than a predetermined pressure, for example.

The heat transfer apparatus 1 further includes a second heat exchanging system 30 having a water inlet 31 for coupling to heat exchanging facilities (not shown), such as refrigerants, air conditioner facilities, or the like, and a water pump 32 coupled to the water inlet 31 to pump or to draw water from the water inlet 31 into the heat exchanger 12.

A water filter 33 and an ion exchange filter 34 are coupled between the water pump 32 and the heat exchanger 12, for filtering negative ions, positive ions, mineral materials, impurities, etc., and for decreasing the electric resistance of the water and the electric conductivity of the water. A switch 35 is coupled between the water filter 33 and/or the ion exchange filter 34 and the heat exchanger 12, for controlling the water flowing into the heat exchanger 12, and thus for decreasing the water temperature and the water pressure after flowing through the heat exchanger 12.

A water tank 36 is coupled to the outlet of the heat exchanger 12, and then coupled to an outlet 37, for supplying the water of lower water temperature and lower water pressure into the heat exchanging facilities again. The water tank 36 includes an entrance 38 for water filling purposes, and an exit 39 for water draining or discharging purposes.

The second heat exchanging system 30 further includes an air relief valve 40 provided therein and coupled between the water pump 32 and the water filter 33 or the ion exchange filter 34, for relieving air bubbles that may be generated within the water, and thus for reducing or avoiding shocks and vibrations that will normally be generated within the water tubing or piping members of the second heat exchanging system 30.

A water detector 41 may further be provided and coupled to the water tank 36, to detect the water quality of the water in the water tank 36, and an electric conductometer 42 may further be provided and coupled to the water detector 41, for detecting and/or displaying the electric conductivity of the water in the water tank 36. A heater 43 may further be provided and coupled to or disposed in the water tank 36, to heat the water in the water tank 36 when required. A pressure gauge 44 may be coupled to the water tank 36 or coupled between the water tank 36 and the outlet 37, for detecting the water pressure in the water tank 36.

A temperature detecting probe or member 45 is coupled to the water tank 36 or coupled between the water tank 36 and the outlet 37, for detecting the water temperature in the water tank 36, and a temperature controller 46 is coupled to the temperature detecting member 45, to control or to actuate the heater 43 to heat the water in the water tank 36 when the temperature detecting member 45 has detected that the water temperature in the water tank 36 is lower than a predetermined temperature, such as 25° C., in order to maintain the water temperature in the water tank 36 around such as 25° C.

A water cycling system 50 may further be provided and includes a water reservoir 51 coupled to the entrance 38 of the water tank 36, for receiving the water from the water tank 36. The water reservoir 51 includes a discharge port 52 coupled to the water pump 32, or coupled between the water pump 32 and the water inlet 31, via a solenoid valve or control valve 53, for supplying the water from the water reservoir 51 to the water inlet 31 or to the water pump 32 of the second heat exchanging system 30.

A check valve 54 may further be provided and coupled between the water filter 33 and the water reservoir 51, for preventing the water from flowing backward into the water reservoir 51 from the water inlet 31 or the water pump 32 or the water filter 33. A pressure or pressure difference detecting member 55 may further be provided and coupled to the water reservoir 51 or coupled between the water reservoir 51 and the entrance 38 of the water tank 36, for detecting the pressure or the pressure difference in the water reservoir 51 or between the water reservoir 51 and the entrance 38 of the water tank 36.

In operation, when the pressure within the second heat exchanging system 30 has been detected to be lower than a predetermined water pressure, such as 4 kg/cm$^2$, by such as the pressure or pressure difference detecting member 55 and/or the pressure gauge 44, the solenoid valve 53 may be actuated to supply the water from the water reservoir 51 to the water inlet 31 or to the water pump 32 of the second heat exchanging system 30, in order to maintain the water pressure in the second heat exchanging system 30 around 4 kg/cm$^2$.

In operation, the water from the heat exchanging facilities may be pumped or drawn into the water inlet 31 of the second heat exchanging system 30, by such as the water pump 32, and may then be pumped to flow into the heat exchanger 12, for heat exchanging with the heat exchanging fluid in the tubing members 13 of the first heat exchanging system 10.

When the temperature detecting member 45 has detected that the water temperature in the water tank 36 is lower than the predetermined temperature, such as 25° C., the temperature controller 46 may actuate the heater 43 to heat the water in the water tank 36 in order to maintain the water temperature in the water tank 36 around such as 25° C.

When the pressure or pressure difference detecting member 55 and/or the pressure gauge 44 has detected that the pressure within the second heat exchanging system 30 is lower than the predetermined water pressure, such as 4 $kg/cm^2$, the solenoid valve 53 may be actuated to supply the water from the water reservoir 51 to the water inlet 31 or to the water pump 32 of the second heat exchanging system 30, in order to maintain the water pressure in the second heat exchanging system 30 around 4 $kg/cm^2$.

In addition, the air relief valve 40 in the second heat exchanging system 30 may be used to relieve the air bubbles that may be generated within the water, and thus to reduce or to avoid the shocks and vibrations that will normally be generated within the water tubing or piping members of the second heat exchanging system 30.

Accordingly, the heat transfer apparatus in accordance with the present invention includes an anti-oxidization device for preventing water tubings from being oxidized by the water flowing through the water tubings, and for reducing air bubbles from being generated within and flown through the water tubings, and thus for reducing or avoiding shocks and vibrations that will normally be generated within the water tubings.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A heat transfer apparatus comprising:

a first heat exchanging system including a condenser and a heat exchanger coupled together, a compressor coupled between said condenser and said heat exchanger for pumping a heat exchanging fluid through said condenser and said heat exchanger, a filter, an expansion valve, and a solenoid valve coupled between said condenser and said heat exchanger, for filtering the heat exchanging fluid and for controlling a flowing of the heat exchanging fluid through said first heat exchanging system, a second heat exchanging system including a water inlet for receiving water, a water pump coupled to said water inlet to force the water from said water inlet into said heat exchanger, a water filter and an ion exchange filter coupled between said water pump and said heat exchanger, to filter negative ions, positive ions, mineral materials, and/or impurities from the water, and for decreasing an electric conductivity of the water, a switch coupled between said ion exchange filter and said heat exchanger, to control the water flowing into said heat exchanger, a water tank coupled to said heat exchanger, and coupled to an outlet, for supplying the water of lower water temperature and lower water pressure out of said second heat exchanging system, said water tank including an entrance and an exit, a water detector coupled to said water tank, to detect water quality in said water tank, an electric conductometer coupled to said water detector, to display an electric conductivity of the water in said water tank, a heater coupled to said water tank, to selectively heat the water in said water tank, a temperature detecting member coupled to said water tank, to detect a water temperature in said water tank, to control and to actuate said heater to heat the water in said water tank when said temperature detecting member has detected that the water temperature in said water tank is lower than a predetermined temperature, and to maintain the water temperature in said second heat exchanging system, a water cycling system including a water reservoir coupled to said entrance of said water tank, to receive the water from said water tank, said water reservoir including a discharge port coupled to said water pump via a control valve, to supply the from said water reservoir to said water pump of said second heat exchanging system, a pressure detecting member coupled to said water reservoir, to detect a pressure in said water reservoir, and to actuate said control valve to supply the water from said water reservoir to said water pump of said second heat exchanging system, and to maintain the water pressure in said second heat exchanging system, and an air relief valve coupled between said water pump and said water filter, to relieve air bubbles generated within the water, and to reduce shocks and vibrations that may be generated within said second heat exchanging system.

2. The heat transfer apparatus as claimed in claim 1, wherein said first heat exchanging system includes a pressure gauge attached and coupled between said condenser and said heat exchanger, to detect a fluid pressure within said first heat exchanging system.

3. The heat transfer apparatus as claimed in claim 1, wherein said first heat exchanging system includes a bypass manifold coupled between said condenser and said heat exchanger, and a switch coupled to said bypass manifold, to control the heat exchanging fluid to directly flow from said condenser to said compressor when the fluid pressure within said first heat exchanging system is detected to be lower than a predetermined pressure.

4. The heat transfer apparatus as claimed in claim 1, wherein said second heat exchanging system includes a check valve coupled between said water filter and said water reservoir, to prevent the water from flowing backward into said water reservoir from said water filter.

5. The heat transfer apparatus as claimed in claim 1, wherein said second heat exchanging system includes a pressure gauge coupled to said water tank, to detect the water pressure in said water tank.

6. The heat transfer apparatus as claimed in claim 1, wherein said second heat exchanging system includes a temperature controller coupled to said temperature detecting member, to control and to actuate said heater when said temperature detecting member has detected that the water temperature in said water tank is lower than a predetermined temperature.

* * * * *